United States Patent [19]

Pielet et al.

[11] Patent Number: 4,736,790

[45] Date of Patent: Apr. 12, 1988

[54] METHOD FOR PREVENTING MOLD EXPLOSIONS DURING CONTINUOUS CASTING OF FREE MACHINING STEEL

[75] Inventors: Howard M. Pielet, Munster, Ind.; Debanshu Bhattacharya, Richton Park, Ill.

[73] Assignee: Inland Steel Company, Chicago, Ill.

[21] Appl. No.: 4,754

[22] Filed: Jan. 7, 1987

Related U.S. Application Data

[63] Continuation of Ser. No. 796,992, Nov. 12, 1985, abandoned.

[51] Int. Cl.[4] ..... B22D 11/07

[52] U.S. Cl. ..... 164/472; 164/478

[58] Field of Search ..... 164/478, 472

[56] References Cited

U.S. PATENT DOCUMENTS

| | | | |
|---|---|---|---|
| 3,645,767 | 2/1972 | Taylor | 164/472 X |
| 3,964,916 | 6/1976 | Armistead et al. | 164/472 X |
| 4,120,344 | 10/1978 | Borg et al. | 164/472 |
| 4,165,780 | 8/1979 | Engeler | 164/473 |

FOREIGN PATENT DOCUMENTS

| | | | |
|---|---|---|---|
| 58-353 | 1/1983 | Japan | 164/472 |
| 58-55156 | 4/1983 | Japan | 164/472 |
| 60-158962 | 8/1985 | Japan . | |
| 2027375 | 2/1980 | United Kingdom | 164/472 |

*Primary Examiner*—Kuang Y. Lin

*Attorney, Agent, or Firm*—Marshall, O'Toole, Gerstein, Murray & Bicknell

[57] ABSTRACT

Molten steel containing lead and/or bismuth is continuously cast without explosions in the casting mold. The mold has sidewalls whose interior surface is coated with a non-organic lubricant which is not violently reactive thermally or chemically, under the conditions of continuous casting existing within the mold, to produce explosions, and does not breakdown under those conditions to produce a compound which is explosive under those conditions. Conventional petroleum-base lubricants for the continuous casting of molten steel are excluded.

10 Claims, No Drawings

METHOD FOR PREVENTING MOLD EXPLOSIONS DURING CONTINUOUS CASTING OF FREE MACHINING STEEL

This application is a continuation of application Ser. No. 796,992, filed Nov. 12, 1985, abandoned.

BACKGROUND OF THE INVENTION

The present invention relates generally to the continuous casting of free-machining steels and more particularly to a method for preventing mold explosions during the vertical continuous casting of molten steel containing at least one of lead and bismuth.

In a vertical continuous casting operation, molten steel is flowed from a ladle into an intermediate container called a tundish having a plurality of spigots in its bottom through which molten steel is flowed into a vertically disposed casting mold having an open upstream end and sidewalls extending from the upstream end to a downstream end initially closed by a so-called "dummy bar" at the bottom of the mold. The sidewalls of the mold are cooled, e.g. with a water jacket, and the molten steel initially contacting the dummy bar and the side-walls solidifies to form a solid shell enclosing unsolidified molten steel. After this initial solidification forming a solid shell, the dummy bar is withdrawn from the mold's downstream end, and the solidified shell containing unsolidified molten steel advances through the mold in a downstream direction, e.g. under the urging of gravity. The portion of the mold vacated by the shell's downstream movement is replenished with additional molten steel.

To facilitate the movement of the partially solidified steel through the mold and to prevent the solidified steel shell from sticking to the inside surface of the mold, a lubricant is employed. The lubricant is typically an organic compound such as a petroleum-base oil, and the lubricant is typically applied to the interior surface of the mold before the casting operation begins. Lubricants are also injected between the molten steel and the interior surface of the mold walls during the casting operation. Typical examples of lubricants employed during the continuous casting of molten steel are set forth in Borg, et al U.S. Pat. No. 4,120,344.

There are problems which occur during the continuous casting of steel containing machinability increasing ingredients, such as bismuth, lead and tellurium, which do not ordinarily occur during the continuous casting of molten steel not containing these ingredients. In the continuous casting of molten steel containing any of these ingredients, explosions occur within the mold when the mold is lubricated with conventional lubricants.

Some attempts have been made in the past to solve these problems. Thus Borg et al, U.S. Pat. No. 4,120,344 teaches the prevention of explosions in tellurium-containing steel by employing, as the mold lubricant, a white mineral oil. Although this expedient prevents mold explosions during the continuous casting of tellurium-containing molten steel, it does not prevent mold explosions during the continuous casting of molten steel containing bismuth.

Engeler, U.S. Pat. No. 4,165,780 discloses a method for preventing mold explosions in the continuous casting of molten steel containing lead. Engeler teaches that mold explosions can be avoided by eliminating the use of oil as a mold lubricant and by employing, as the mold lubricant, a mixture of a liquid inert gas (e.g. nitrogen) and a flux powder (e.g. carbon particles) applied atop the molten steel in the mold, while at the same time oscillating the mold back and forth along the path of movement of the steel through the mold. The mixture of inert gas and flux powder forms a layer atop the molten steel, and the thickness of the layer is controlled so that it is less than the length of the stroke of the oscillating mold. The Engeler method is relatively complicated and requires continuous monitoring.

SUMMARY OF THE INVENTION

A method in accordance with the present invention eliminates mold explosions during vertical the continuous casting of molten steel containing bismuth or lead, without employing the complicated procedure described in Engeler. In accordance with the present invention, the interior surface of the vertically disposed continuous casting mold is lubricated, before the start of the cast, with a non-organic material (a) which acts as a lubricant on the mold surface, (b) which is not violently reactive thermally or chemically, under the conditions of continuous casting existing within the mold, to produce explosions and (c) which does not break down under those conditions to produce a compound which is explosive under those conditions. A preferred lubricant in accordance with the present invention is molybdenum disulfide. Other lubricants which may be used in accordance with the present invention are lithium sulfide and graphite.

Oils and other conventional lubricants heretofore used during the continuous casting of molten steel, but which have produced explosions when the molten steel contained bismuth or lead, are excluded from the mold. The non-organic compound employed as a lubricant in accordance with the present invention is devoid of liquified inert gases, such as liquid nitrogen, and the method of the present invention is performed without having to relate the thickness of a lubricant-containing layer to the stroke of the oscillating mold.

In addition to at least one of lead and bismuth, the molten steel may also contain tellurium and the method of the present invention is equally effective in preventing mold explosions when tellurium is present in the molten steel, either with or without lead and/or bismuth.

Other features and advantages are inherent in the method claimed and disclosed or will become apparent to those skilled in the art from the following detailed description.

DETAILED DESCRIPTION

The present invention is employed in connection with molten steel containing at least one of the machinability increasing ingredients lead and bismuth, alone or in combination, in machinability increasing amounts. The steel may also contain tellurium as an additional machinability increasing ingredient. Typical examples of machinability increasing amounts for each of these ingredients are: 0.05–0.50 wt.% lead; 0.04–0.40 wt.% bismuth; and 0.02–0.06 wt.% tellurium. The present invention is applicable to any steel composition heretofore containing these elements as described in the preceding part of this paragraph.

Molten steel having a composition in accordance with the preceding paragraph is introduced into a vertically disposed continuous casting mold having sidewalls with an interior surface coated with a lubricant in accordance with the present invention. The lubricant is preferably molybdenum disulfide. Other lubricants which may be employed comprise lithium sulfide and powdered graphite. This lubricant does not contain liquified inert gases, such as liquid nitrogen.

The lubricant is applied to the interior surface of the mold walls before the molten steel is introduced into the mold. When the casting mold is coated with such a lubricant at the start of the cast, the solid steel shell with incompletely solidified molten steel therein advances through the mold without sticking to the side walls of the mold, and there are no mold explosions.

Excluded from the interior of the mold is any organic compound which produces explosions under the conditions existing within the mold during continuous casting. Thus excluded from the mold are petroleum based oils conventionally used as a mold lubricant in the continuous casting of molten steel, and this includes white mineral oil among the excluded organic compounds when the molten steel contains bismuth.

After the casting mold has been at least partially filled with molten steel, a flux powder composed of non-organic material is added atop the molten steel and maintained there during substantially the rest of the casting operation. The flux powder may be of any conventional composition heretofore used for that purpose provided that the flux powder is not violently reactive chemically or thermally, under the conditions of continuous casting existing within the mold, to produce explosions, and does not break down under such conditions to produce a compound which is explosive under such conditions. Such flux powder can also provide a lubricant between the molten steel and the interior surface of the mold walls at a time during the casting operation when the lubricant applied before the start of the casting operation has worn off. Examples of such flux powders are substantially as set forth below.

| | PARTS BY WT. | | |
|---|---|---|---|
| INGREDIENT | A | B | C |
| $SiO_2$ | 11 | 28 | 28 |
| $Al_2O_3$ | 1 | 13 | 1.5 |
| MgO | 0.5 | 1 | 0.1 |
| CaO | 11 | 23 | 3 |
| $CaF_2$ | 40 | 12 | 16 |
| $Na_2O$ | 18 | 5 | 28 |
| $B_2O_3$ | 16 | 0.4 | 1 |
| C | 0.2 | 6 | 0.3 |
| FeO | 0.3 | 4 | 0.1 |
| $P_2O_5$ | — | — | 12 |

During the casting operation, the mold may be oscillated back and forth along the path of movement of the steel through the mold (i.e., up and down oscillation). The oscillation has a predeterminated stroke length, but there is no requirement that one relate the thickness of any lubricant-containing layer atop the molten steel in the mold to the length of the stroke of the oscillating mold.

It may also be desirable to position in the bottom of the mold, just above the dummy bar, an aluminum deoxidant typically in the form of an aluminum wire strung back and forth across the interior of the mold, near the bottom thereof, before the start of the casting operation. A typical continuous casting mold with which the present invention is employed has cross sectional dimensions of 360 mm by 520 mm and a depth of 500 mm to the dummy bar, at the start of the casting operation. In such a mold, about 150 grams of aluminum wire is employed.

The lubricant employed in the present invention is not violently reactive thermally or chemically under the conditions of continuous casting existing within the mold, and thus it will not produce explosions, and it does not break down under those conditions to produce a compound which is explosive under those conditions. This is in contrast to lubricating oils conventionally utilized as a mold lubricant in the continuous casting of molten steel. Such lubricants will cause mold explosions when the steel contains lead, bismuth or tellurium, and thus must be excluded from the mold during the continuous casting of molten steel containing those ingredients. White mineral oil, heretofore employed as a lubricant for molten steel containing tellurium may not be employed as a lubricant when the molten steel contains bismuth because the white mineral oil will cause mold explosions if employed in the continuous casting of molten steel containing that ingredient.

The foregoing detailed description has been given for clearness of understanding only, and no unnecessary limitations should be understood therefrom, as modifications will be obvious to those skilled in the art.

We claim:

1. In the operation of a vertically disposed continuous casting mold for the vertical continuous casting of molten steel containing at least one of the elements bismuth and lead in machinability increasing amounts, wherein said molten steel is introduced into a vertically disposed continuous casting mold having an interior surface, said molten steel is at least partially solidified in said mold to form a solid shell, and before the start of the cast, said interior surface is lubricated with a mold lubricant to prevent the sticking of said shell to said interior surface during the cast, a method for reducing explosions within said mold, said method comprising:

employing, as the lubricant which prevents said sticking, a non-metallic, non-organic material (a) which acts as a lubricant on said surface, (b) which is not violently reactive thermally or chemically, under the conditions of continuous casting existing within said mold, to produce explosions, (c) which does not break down under said conditions to produce a compound which is explosive under said conditions and (d) which wears off during the casting operation;

applying said lubricant to the interior surface of said mold before the start of each cast, to prevent said sticking;

and excluding from said mold any organic compound which produces explosions under said conditions.

2. A method as recited in claim 1 wherein:

said non-organic material is molybdenum disulfide.

3. A method as recited in claim 1 wherein:

said non-organic material is lithium sulfide.

4. A method as recited in claim 1 wherein:

said non-organic material is graphite.

5. A method as recited in claim 1 wherein:

said excluded organic compound is an oil.

6. A method as recited in claim 5 wherein:

the excluded oil is a compound conventionally used as a mold lubricant in the continuous casting of molten steel.

7. A method as recited in claim 1 and comprising:

providing a lubricant-containing layer atop the molten steel in said mold after but not before the mold has been at least partially filled with said molten steel;

maintaining said layer atop the molten steel substantially throughout the casting operation;

oscillating said mold back and forth along the path of movement of said steel through said mold;

said method being performed without relating the thickness of said lubricant-containing layer to the length of the stroke of the oscillating mold.

8. A method as recited in claim 7 wherein:

said lubricant-containing layer comprises a flux powder which is not violently reactive chemically or thermally, under the conditions of continuous casting existing within the mold, to produce explosions, and does not break down under such conditions to produce a compound which is explosive under said conditions.

9. A method as recited in claim 1 wherein:

said non-organic material is devoid of a liquified inert gas.

10. A method as recited in claim 1 wherein:

said molten steel also contains tellurium in machinability increasing amounts.

* * * * *